United States Patent [19]

Jageler

[11] Patent Number: 4,466,495

[45] Date of Patent: Aug. 21, 1984

[54] PRESSURE CORE BARREL FOR THE SIDEWALL CORING TOOL

[75] Inventor: Alfred H. Jageler, Tulsa, Okla.

[73] Assignee: The Standard Oil Company, Chicago, Ill.

[21] Appl. No.: 481,091

[22] Filed: Mar. 31, 1983

[51] Int. Cl.[3] ..... E21B 49/06

[52] U.S. Cl. ..... 175/59; 175/78

[58] Field of Search ..... 175/59, 58, 45, 78, 175/226, 233; 73/864.45

[56] References Cited

U.S. PATENT DOCUMENTS

| | | | |
|---|---|---|---|
| 2,373,323 | 4/1945 | MacReady | 175/59 |
| 4,142,594 | 3/1979 | Thompson et al. | 175/59 |
| 4,230,192 | 10/1980 | Pfannkuche | 175/59 |
| 4,256,192 | 3/1981 | Aumann | 175/233 |
| 4,272,987 | 6/1981 | Aumann et al. | 175/153 |
| 4,317,490 | 3/1982 | Milberger et al. | 175/59 X |
| 4,354,558 | 10/1982 | Jageler et al. | 175/45 |

*Primary Examiner*—Ernest R. Purser
*Assistant Examiner*—Thuy M. Bui
*Attorney, Agent, or Firm*—John D. Gassett; Fred E. Hook

[57] ABSTRACT

This relates to a pressure coring tool to obtain pressurized samples of the formation through which the wellbore is drilled. It includes a housing which supports a guide means along which the drill bit, core barrel and motor can be moved to extend or retract the cutting bit and core barrel along a selected path which preferably is horizontal. The core barrel is retracted inwardly on a horizontal path and tilted in an upward position such as the outer end of the core barrel is higher than the end near the barrel. Means are provided to pressure seal the cut core within the core barrel.

10 Claims, 21 Drawing Figures

FIG.3A
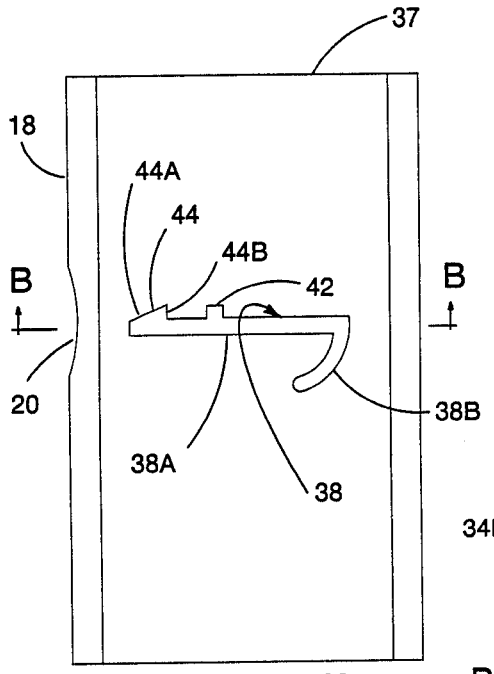
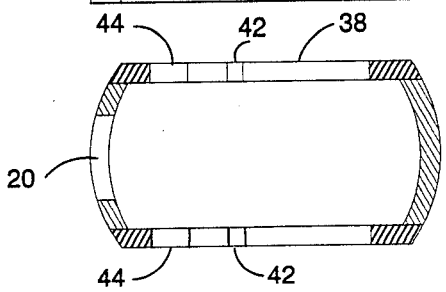
FIG.3B
FIG.4A
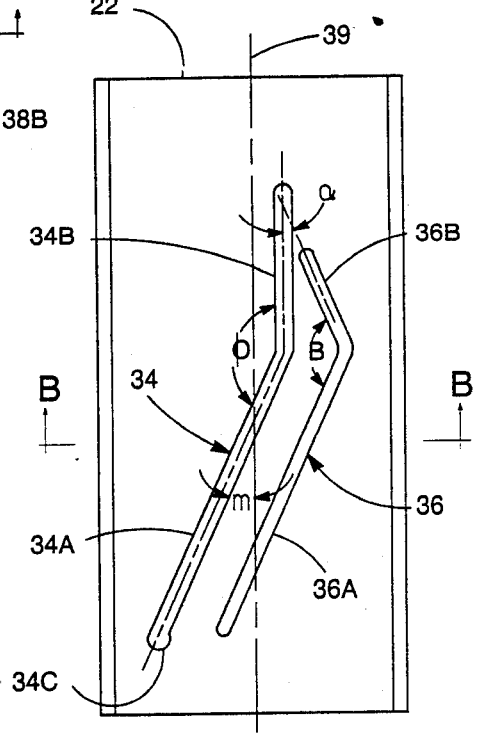
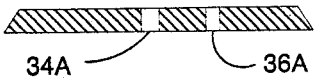
FIG.4B

PRESSURE CORE BARREL FOR THE SIDEWALL CORING TOOL

This application is related to copending application Ser. No. 426,304, entitled "Guide for Sidewall Coring Bit Assembly," Filed: Sept. 29, 1982, Alfred H. Jageler, Gary D. Bruce, and Houston B. Mount II, inventors.

BACKGROUND OF THE INVENTION

This invention relates to sidewall coring tools used to obtain samples of the formation through which a borehole is drilled. In determining the physical properties of subterranean formations, it is of great assistance to have samples of the formation which are commonly called cores. A core is typically a cylindrical piece of the rock which has been cut from the underground formation that can vary in size and length. A typical size is ½ inch in diameter and 4 to 6 inches long although samples can be of larger diameters and of greater length depending on the facilities available. One type of core cutter is the type to be used to cut the cores from the sidewall of a borehole after the borehole has already been drilled. Such a sidewall coring tool is described in U.S. Pat. No. 4,354,558 entitled "Apparatus and Method for Drilling into the Sidewall of a Drill Hole," issued Oct. 19, 1982, Alfred H. Jageler, Robert A. Broding, Lauren G. Kilmer, inventors. This invention relates to such a sidewall coring tool.

SUMMARY OF THE INVENTION

This invention relates to a core cutting apparatus and method for use in cutting a sidewall core in a borehole drilled in the earth. This includes an elongated frame or a housing (usually cylindrical) which supports a guide means along which the drill bit and the motor of the core cutting apparatus can be moved to extend and retract the cutting bit and core barrel along a selected path through an opening in the housing. The preferred path is such that it causes a coring bit to cut a core horizontally—that is, perpendicular to the longitudinal axis of the housing. Once the core has been cut, the core barrel is retracted inwardly into the housing and then tilted into an upward position such that the outer or bit end of the core barrel is at a higher elevation than the other end of the core barrel near the motor. When the core barrel with the cut core therein is tilted to its uppermost position, a sealing plug is inserted in the upper end through the hollow coring bit and is pushed into the core barrel proper. Means are provided to retain the sealing plug in this position. The core is thus sealed at the pressure in the borehole at the level at which it was cut. The core under pressure is then retrieved to the surface where it can be analyzed in a known manner. This invention is not restricted to cutting a horizontal core, although this seems to be the most likely manner in which the sidewall coring tool will be used.

A better understanding of the invention may be had from the following description taken in conjunction with the drawings.

BRIEF DESCRIPTION OF THE DRAWINGS

FIG. 3A is a view of a fixed plate showing the horizontal section and arcuate section of the fixed slot.

FIG. 3B is a view taken along the line B—B of FIG. 3A.

FIG. 4A is a schematic of the drive plate showing the pair of slots therein.

FIG. 4B is a section taken along the line B—B of FIG. 4A.

DETAILED DESCRIPTION OF THE INVENTION

Figure 1:
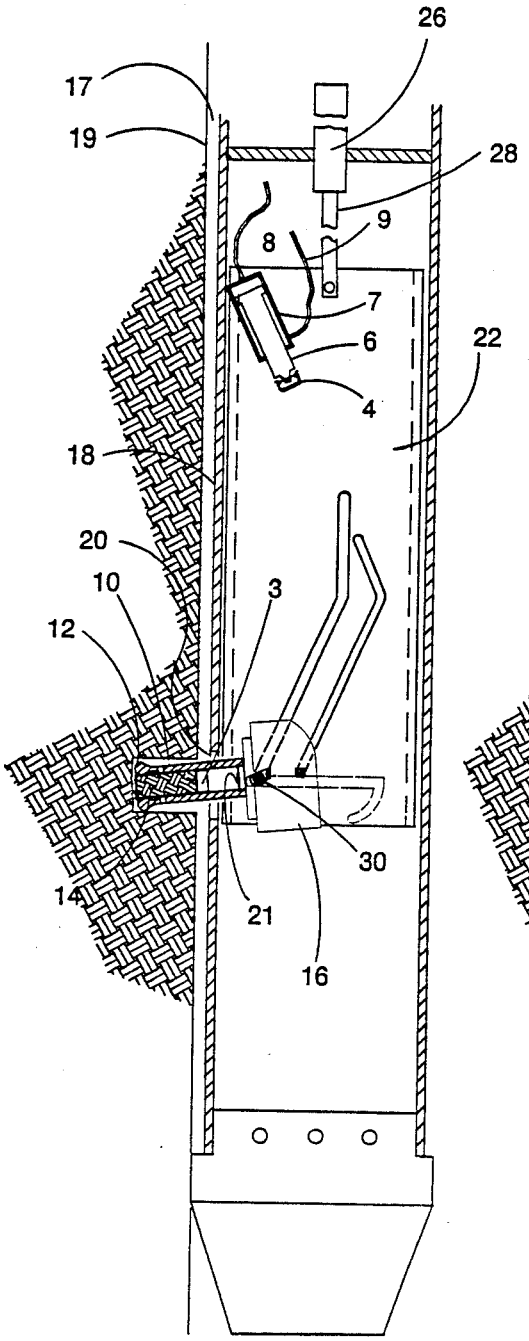
FIG. 1 is a schematic view depicting a core cutting means, including means for sealing the core within the core barrel, suspended in a borehole and core bit and core barrel fully extended and containing a cut core.

FIG. 1 illustrates a pressure core retaining barrel 10 having a core bit 12 in an extended position and also containing a cut core 14. The core bit 12 is rotated by a barrel 10 connected to and rotated by motor 16 which preferably is hydraulic. The motor is supported within an elongated frame member 18 which is preferably a steel cylinder having an opening 20 through which the core barrel 10 extends. Elongated member 18 is suspended by means not shown in hole 17 having a sidewall 19. Power for rotating the hydraulic motor 16 is provided by means not shown which can be similar to that shown in said U.S. Pat. No. 4,354,558.

Figure 1A:
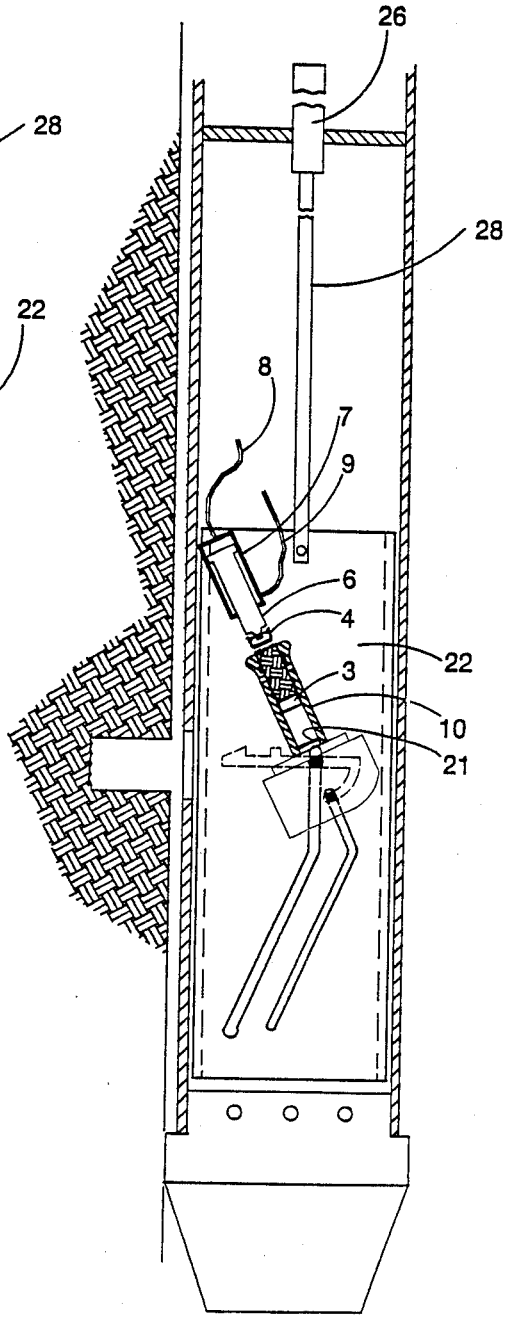
FIG. 1A is a schematic view depicting the core cutting means of FIG. 1 in a retracted position with a retained core.
Figure 2:
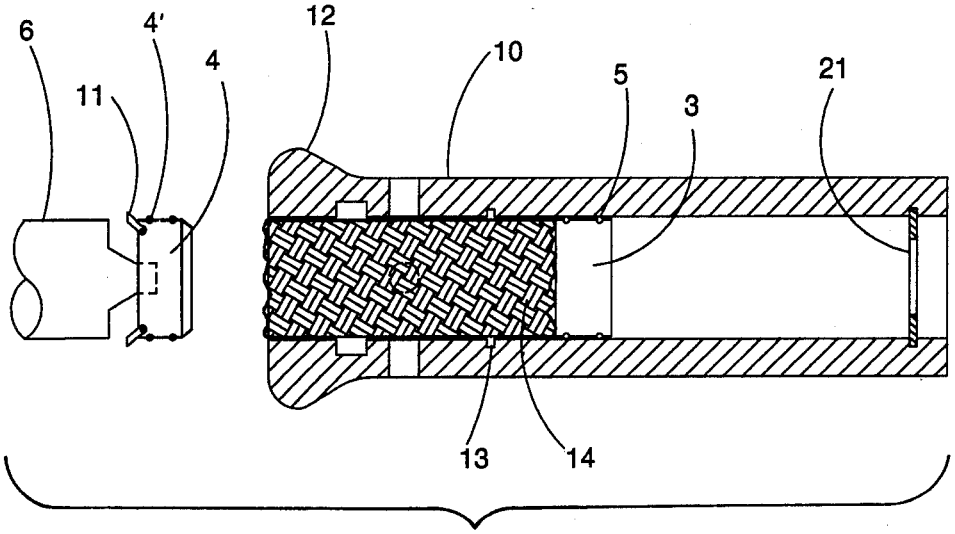
FIG. 2 is an enlarged view of the core barrel and sealing means of FIG. 1 and FIG. 1A.

Attention now will be directly briefly to FIG. 2 which illustrates the pressure core barrel 10 of FIGS. 1 and 1A and illustrates the means for sealing the cut core 14 therein. FIG. 2 illustrates the core barrel 10 having a piston or sealing plug 3 with seals 5 which is placed in the barrel 10 through cutting head 12. A retaining ring 21 is provided in the end of the core barrel opposite the cutting head 12. Also near the outer end is a locking groove 13. Also shown in FIG. 2 is a sealing piston or plug 4 having seals 4' thereon and locking fingers 11. These locking fingers 11 are spring loaded or otherwise biased outwardly from the center of the plug. The core barrel is preferably cylindrical as are the sealing plugs 3 and 4. A piston extension 6 supports the plug 4 and as will be seen, it is what drives the plug 4 into the core barrel 10 after the core is cut and the barrel retracted and tilted.

Figure 2A:
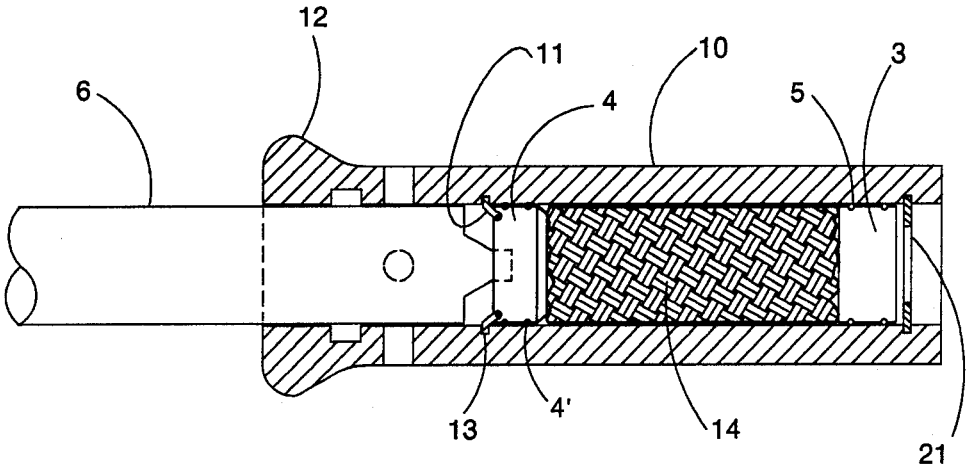
FIG. 2A is similar to FIG. 2 except that the core has been sealed in the core barrel.

FIG. 2A illustrates the pressure core barrel 10 of FIG. 2 after the core has been cut and is sealed by plugs 3 and 4. Plug 4 is reasonably held to piston extension 6 by any desirable means such as by a friction fit or threaded connection. Plug 4 is injected through the head 12 by piston extension 6 and forces the plug 4 against the broken end of core 14 and drives it and plug 3 to the right until the position of the core is as shown in FIG. 2A where the plug 3 abuts retaining ring 21. At that point, fingers 11 of piston 4 locks into engagement with locking groove 13.

Also shown in FIG. 1 is drive plate 22 which is movable with respect to housing 18. Plate 22 is slidably mounted from the housing 18 by any well-known means such as bearings. Drive motor 26 having ram 28 is supported from housing 18. Ram 28 is connected to movable plate 22 and is used for moving the drive plate 22 in either an up or down direction. Mounted on movable plate 22 is cylinder 7 having piston and extension 6 therein. Extension 6 is also illustrated in FIG. 2. Cylinder 7 is arranged on drive plate 22 such that when the drive plate is moved to the position so that the core barrel 10 is in the position shown in FIG. 1A, piston extension 6 is aligned with the bore of core barrel 10. Hydraulic supply lines 8 and 9 are provided for extending or retracting piston and piston extension 6. Fluid to or from these lines may be controlled from the surface. FIG. 1A is similar to FIG. 1 except the core barrel with the core has been retracted and is in an upwardly tilted position. The cylinder 7 may be now actuated and the core will be sealed in the position illustrated in FIG. 2A. Once the core is sealed as illustrated in FIG. 2A, the coring tool may be raised to the surface where the sealed pressure core barrel 10 is retrieved and the core has been retained at the same pressure as it was when it was first cut in the borehole. The core can then be analyzed in any known manner.

While this invention can be used with any sidewall coring barrel which is extended to cut a core and then retracted, it is considered that its major use will be with the mechanism by which the cores are cut with the core barrel in a horizontal position, retracted and then tilted upwardly. This mechanism for obtaining the horizontal cutting and the retraction and upward tilting of the core barrel is illustrated in said patent application Ser. No. 426,304. I shall next describe herein such core barrel as shown in FIGS. 3A through 16.

Figure 5:
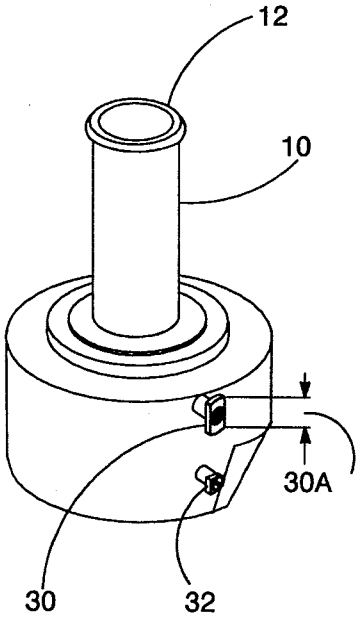
FIG. 5 is an isometric view of the motor, the core bit and core barrel.

FIGS. 3A and 3B illustrate the fixed plate and the fixed slot means and FIGS. 4A and 4B illustrate the sliding or drive plate and the sliding slots therein. In FIG. 3A, there is shown fixed slot 38 having a horizontal straight section 38A. On the other end of the straight section opposite the opening 20 is an arcuate section 38B. Horizontal section 38A is perpendicular to the longitudinal axis of the housing 18. It also has a first break slot 42 and a second break or clearance slot 44. These two slots are the same distance apart as are pinions 30 and 32 of motor 16 as shown in FIG. 5. Forward pinion 30, which is illustrated in FIG. 1 and more clearly in FIG. 5, has a longitudinal dimension 30A which is greater than the width of slot 42. The trailing pinion 32 is of a dimension so it can enter slot 42. The reason for this will be explained later. As shown in FIG. 3A, slot 44 has a slightly sloping surface 44A and average depth 44B which is slightly shallower than the depth of slot 42. The arcuate section 38B has a radius equal to the distance between forward pinion 30 and trailing pinion 32. As will be seen, the horizontal section 38A together with the slots of the sliding plate 22 provides for the extension and retraction in a horizontal direction of the drilling assembly including the motor 16, core barrel 10 and bit 12. The arcuate section 38B in cooperation with the slots of the sliding plate provides for the tilting or rotation of the drilling assembly between the horizontal position of FIG. 1 and the tilted position as shown in FIG. 2.

Attention is next directed to FIGS. 4A and 4B which slows the sliding or drive plate 22. It has a forward slot 34 and a trailing slot 36. Forward slot 34 has a lower section 34A which has a break slot 34C at the lower end. Forward slot 34 has an upper straight section 34B which makes an angle $\phi$ with the lower slot 34A. Trailing slot 36 has a lower section 36A which is parallel to the lower section 34A of the leading slot or forward slot and an upper section 36B which makes an angle $\beta$ with the lower section 36A. Angle $\beta$ is greater than the angle $\phi$. Angle $\phi$ and angle $\beta$ are such as to obtain the proper tilting of the drilling assembly in cooperation with the fixed slot 38. In a preferred embodiment, upper section 34B is parallel to the longitudinal axis 39 of the sliding plate 22. Thus, when in an upright position upper section 34B is vertical. In one preferred embodiment, angle $\phi$ between the lower section 34A and upper section 34B is approximately 155° and angle $\beta$ between the lower section 36A and upper section 36B is approximately 130°. Also in this preferred embodiment the angle m between section 34A and longitudinal axis 39 is approximately 30° and the angle of upper section 36B of trailing slot 36 makes an angle $\alpha$ with the line 39. Typically, angle $\phi$ can be between about 140° and 170°, angle $\beta$ between about 120° and 140°, angle $\alpha$ between about 20° and 40° and angle m between about 20° and 40°. Typically, slot 34 extends through the sliding plate 22 and is typically about 0.252 inches in width. The lower break slot 34C has a configuration which can accommodate movement of and receive forward pinion 30. Fixed slot 38 may, but need not, extend through fixed plate 37. The width of fixed slot 38 is typically about 0.252 inches. Typically, the width of pinions 30 and 32 which slide through these various slots is about 0.25 inches which gives a clearance of about 0.002 inches. The slot must be at such an angle to provide the most force on the pinion for a given direction and with the least amount of friction.

Figure 6:
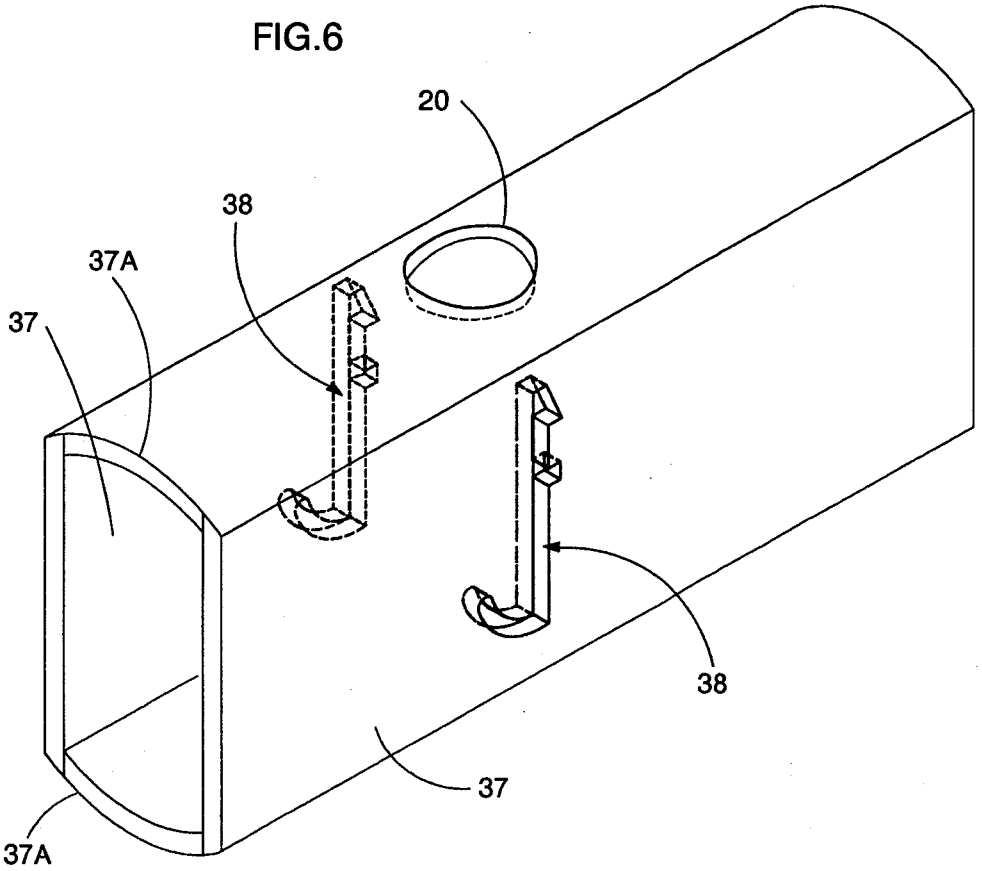
FIG. 6 is an isometric view showing the guide slot means in the fixed plates.

Attention is now directed to FIG. 6 which illustrates the fixed plate means shown in FIG. 3B in isometric form. Fixed plate 37 also has side members 37A which can be a part of the housing. The exterior of the housing 18 is preferably as illustrated in FIG. 1. However, this is not necessarily the case.

Figures 7, 7A:
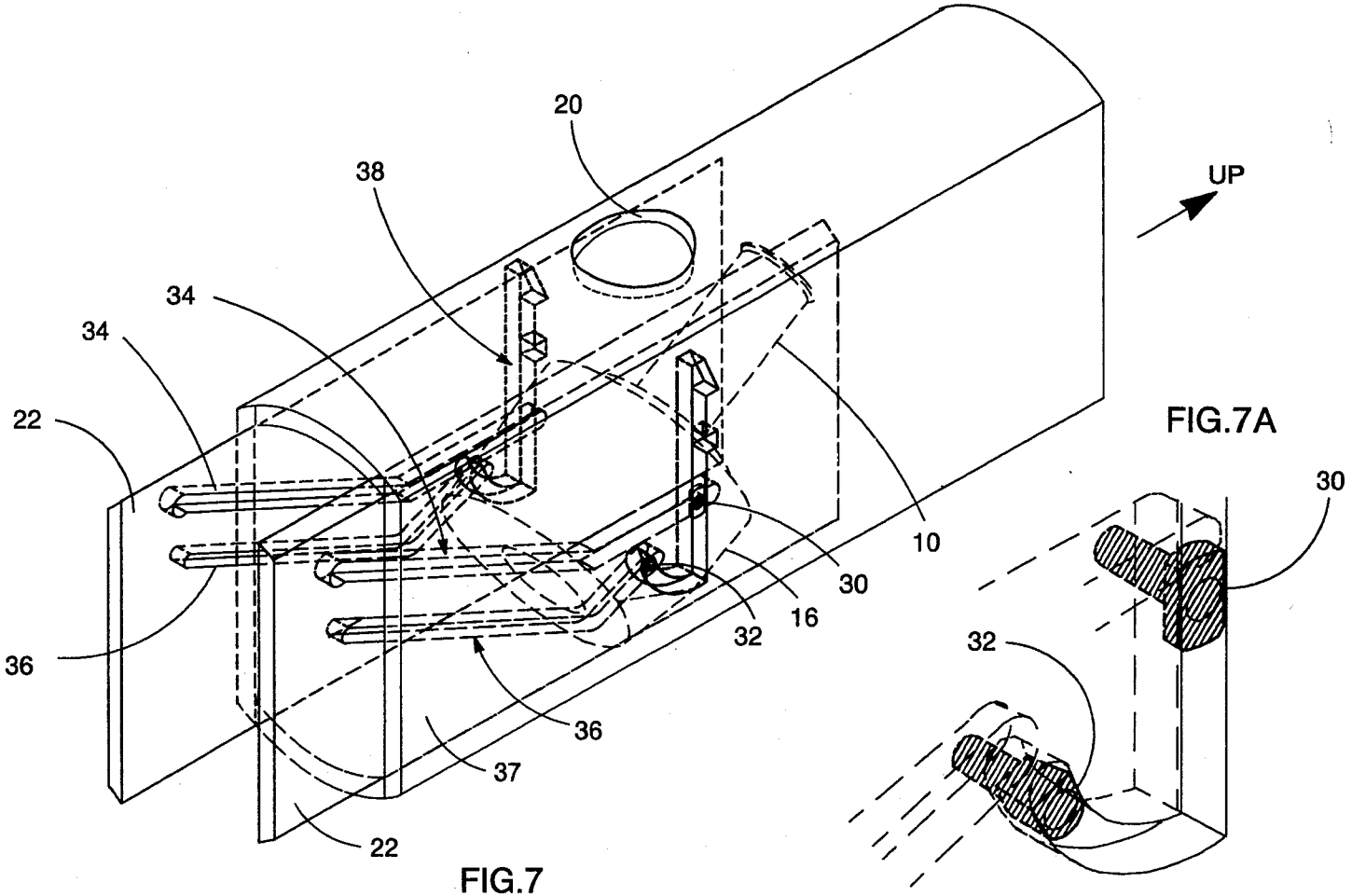
FIG. 7 is an isometric view showing the fixed plate in relation to the drive plate and motor and cutting assembly.
FIG. 7A is an isometric view showing the guide pinions of the motor.
Figure 8:
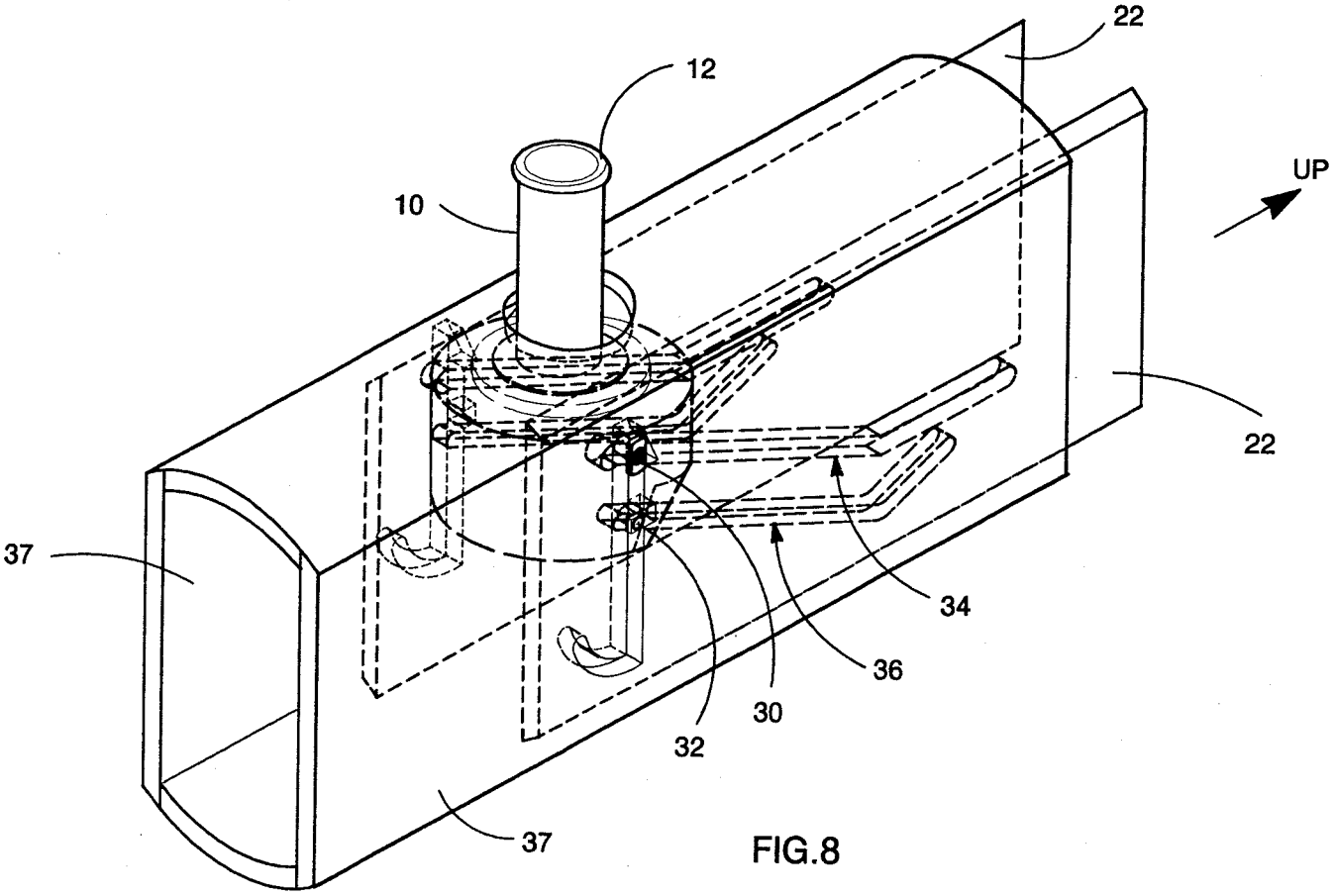
FIG. 8 is similar to FIG. 7 except that the motor and cutting assembly have been rotated and extended.
Figure 9:
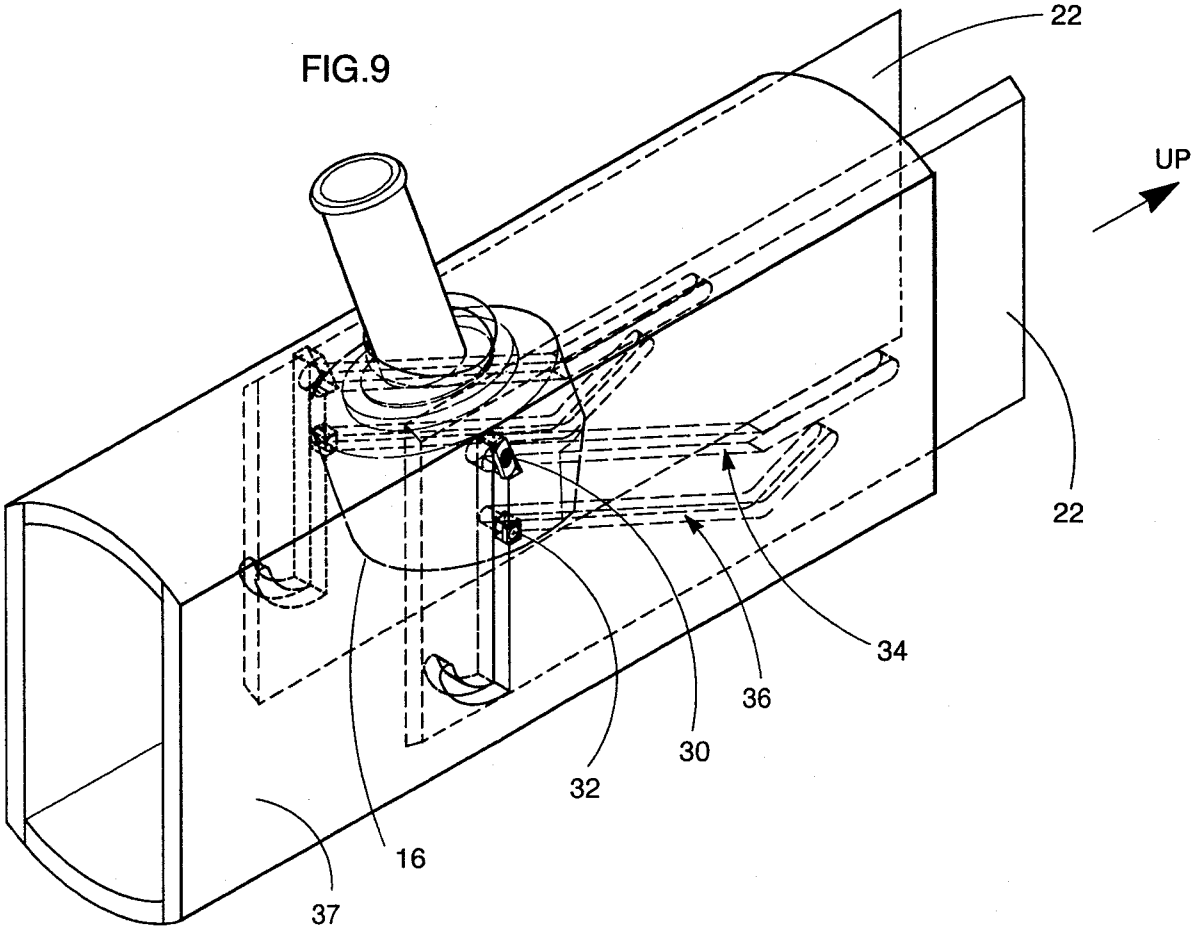
FIG. 9 is similar to FIG. 8 except that the core cutting mechanism has been tilted by the break mechanism.

Attention is next directed to FIG. 7 which is similar to FIG. 6 with the exception that the two sliding plates 22 and motor 16 with pinions 30 and 32 have been indicated therein. As can be seen, when in this position, core barrel 10 is tilted in an upwardly position. FIG. 7A shows the preferred shape in enlarged view of the pinion 30 and 32 of FIG. 7. FIG. 8 is similar to FIG. 7 except that the plates 22 have been moved upwardly with respect to fixed plate 37 such that core barrel 10 and bit 12 are in a horizontal position. FIG. 9 is similar to FIG. 8 except it shows that the pinions 30 and 32 are in the break slot positions and core barrel 10 has been tilted slightly.

Figure 10:
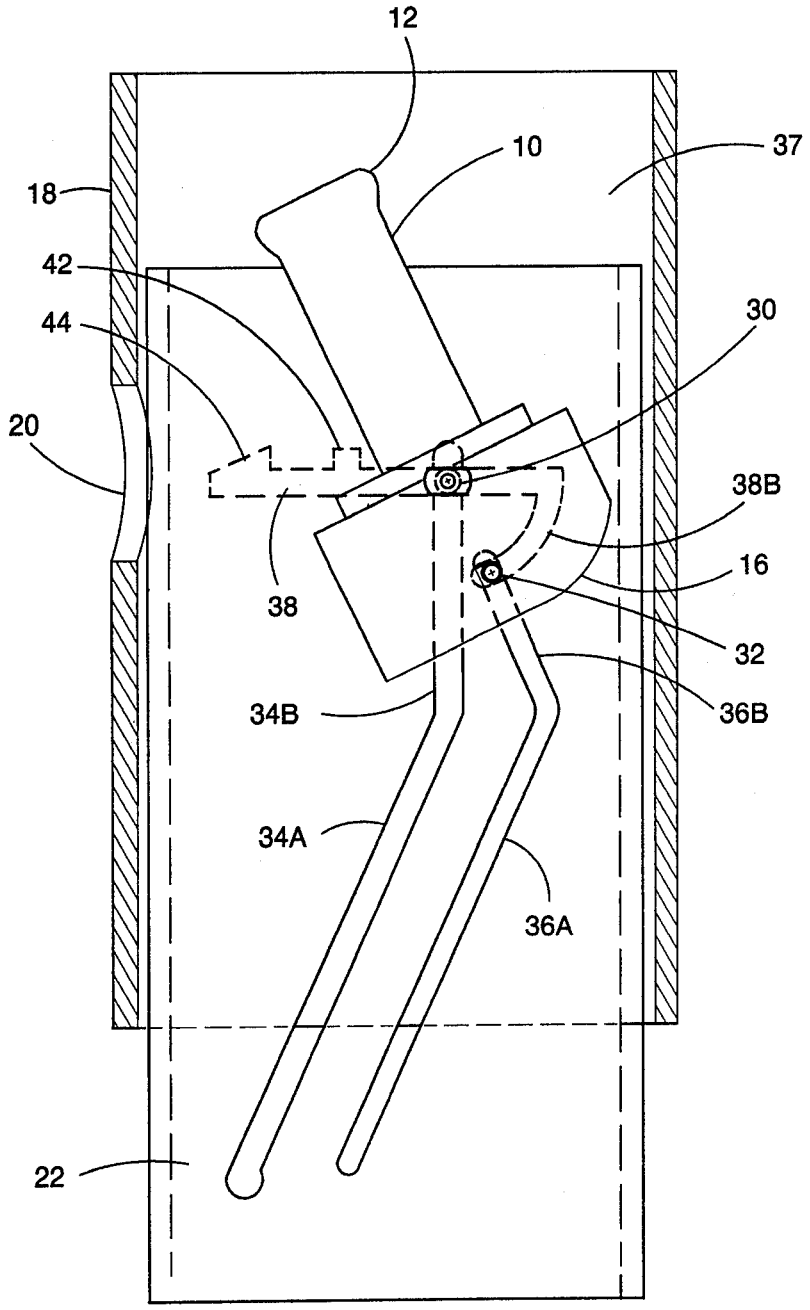
FIG. 10 is a plan view showing the relationship of the slots of the fixed plate and drive plate when the core barrel is in a completely retracted and most upwardly tilted position.
Figure 11:
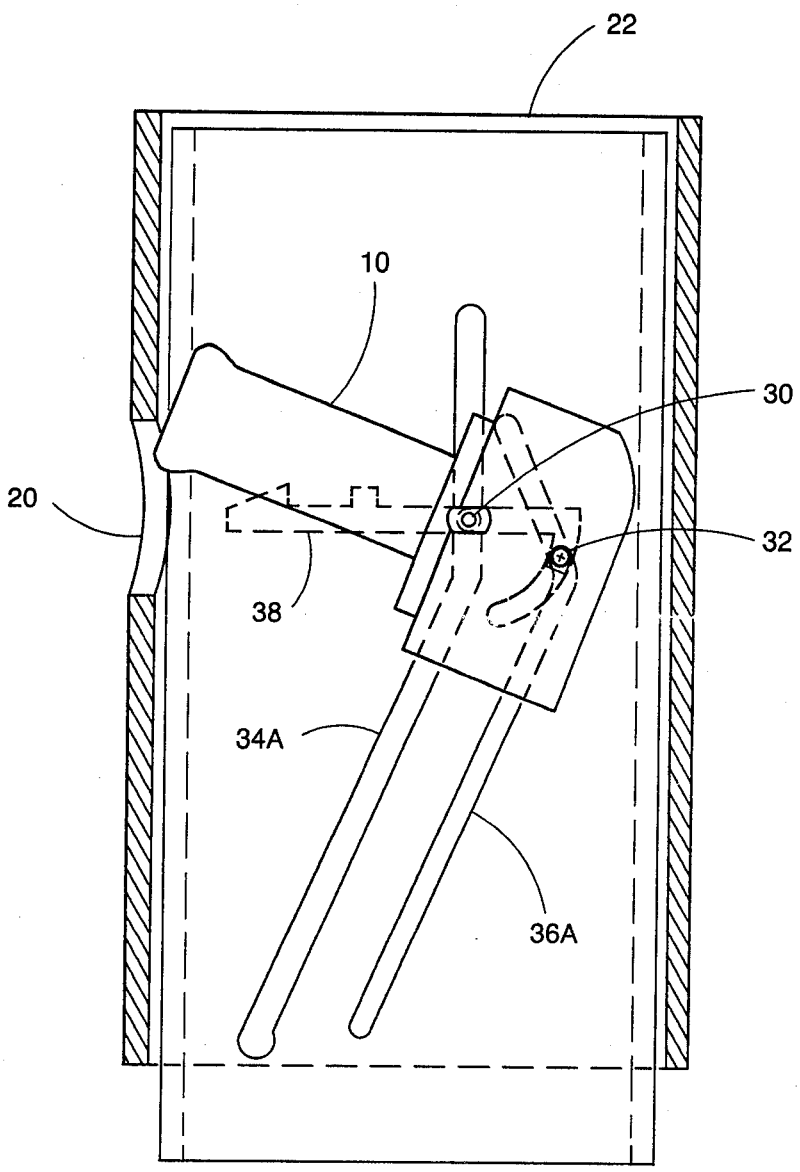
FIG. 11 is similar to FIG. 10 except the drive plate has been moved upwardly and the core barrel has been tilted downwardly.
Figure 12:
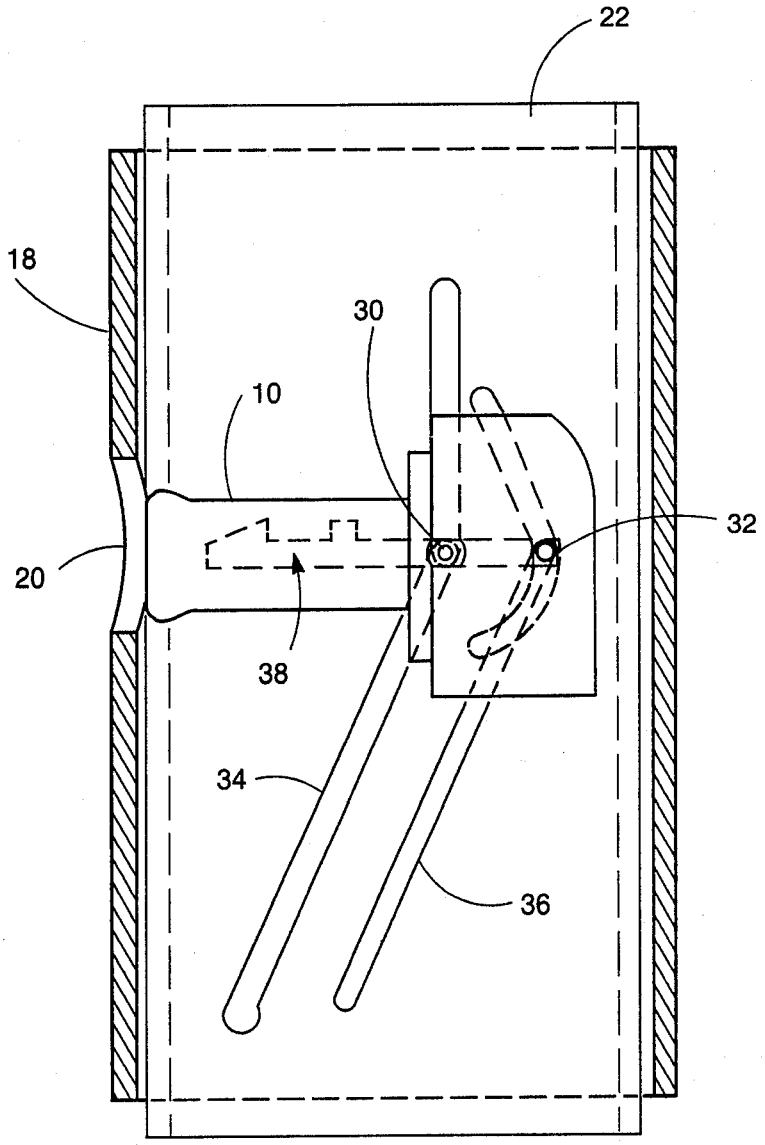
FIG. 12 is similar to FIG. 10 except in this figure the core barrel is in a horizontal position.

FIGS. 10–16 show the relationship of various relative positions between fixed plate 37 and the movable plate 22. The various parts shown in these Figures are identical except for the relationship caused by the change in the position of the movable or drive plate 22. In FIG. 10, core barrel 10 is tilted downwardly the maximum position for the particular configuration of guide slots. As can be seen the trailing pinion 32 is in the lower extremity of arcuate section 38B of the fixed slot. In FIG. 11, forward pinion 30 is still in the same position and only trailing pinion 38 has moved around the arcuate section 38B and core barrel 10 has been rotated downwardly from the position of FIG. 10. This is accomplished by movement of drive plate 22 upwardly from that shown in FIG. 10. In FIG. 12 drive plate 22 has continued to move upwardly and is now in a position where trailing pinion 32 is in line with the horizontal section of fixed slot 38. When in this position, the core barrel 10 is horizontal or perpendicular to the longitudinal axis of the fixed plate 37.

Figure 13:
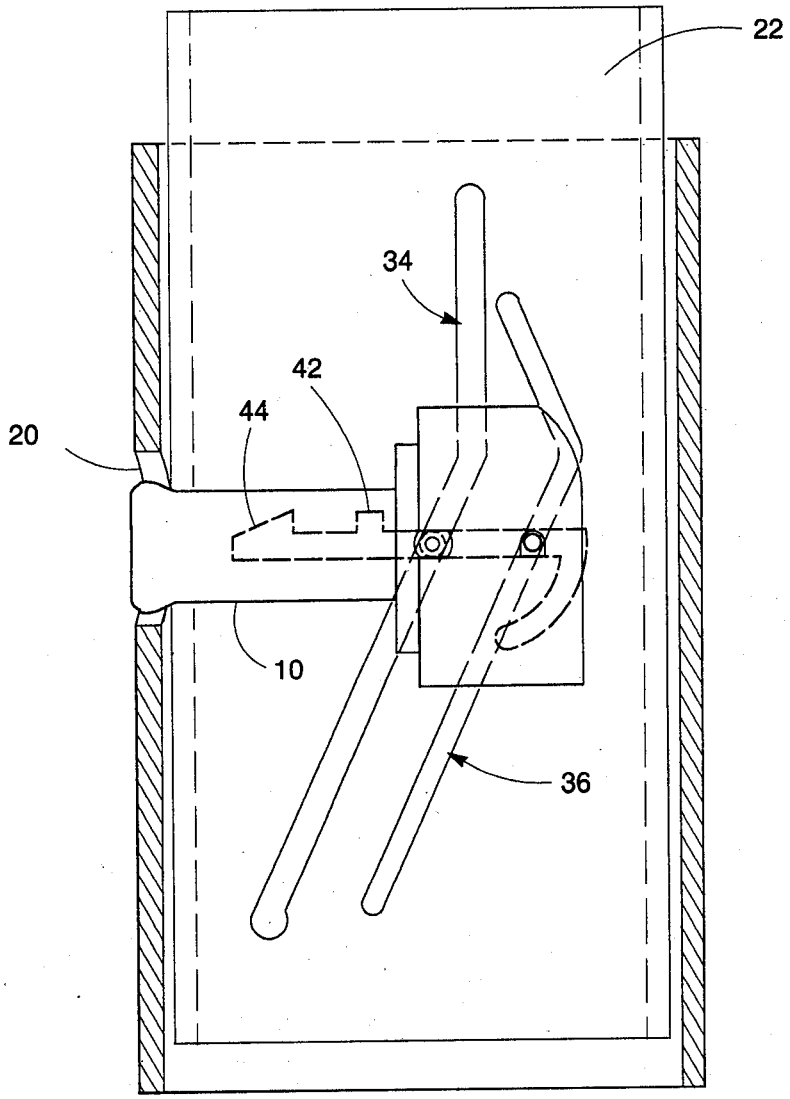
FIG. 13 is similar to FIG. 12 except that the drive plate has been moved up slightly, and the core barrel is slightly more extended than in FIG. 12.
Figure 14:
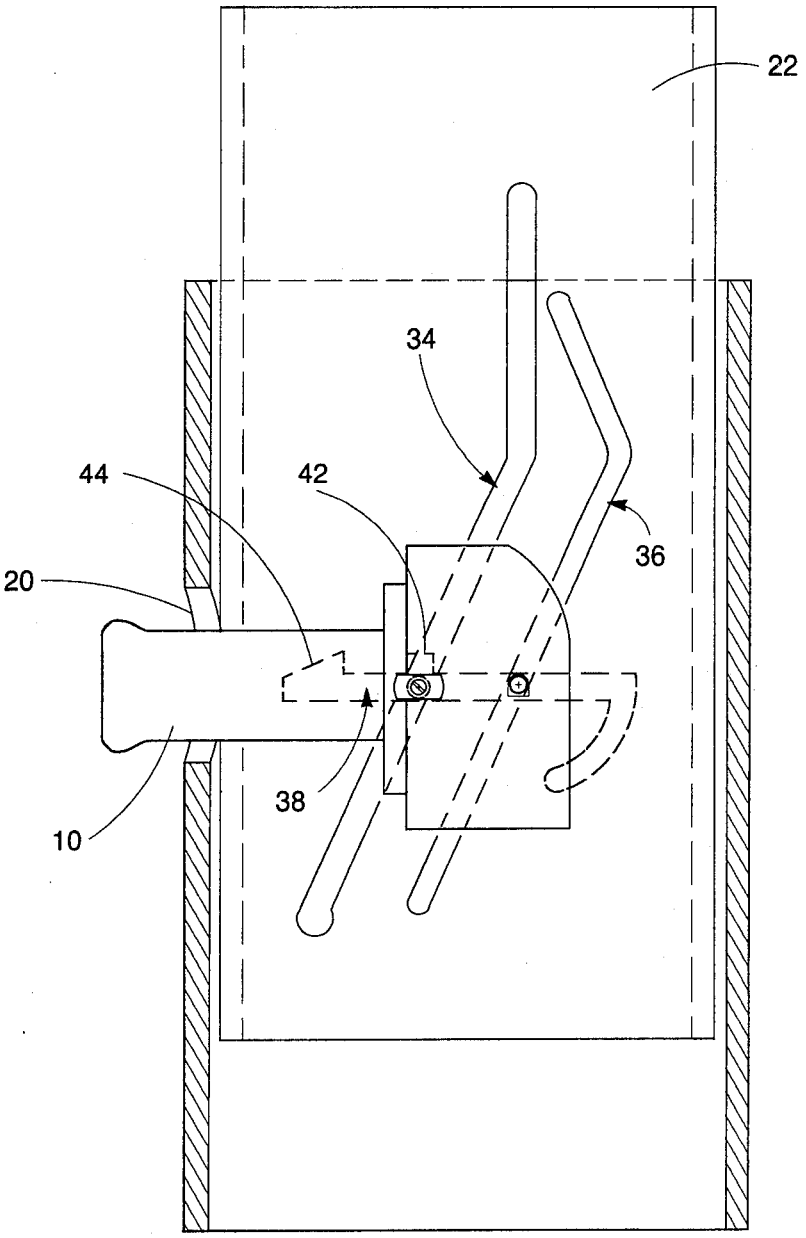
FIG. 14 is similar to FIG. 13 and shows a core barrel extended further.

Additional upward movement of drive plate 22 cause the core barrel 10 to extend through opening 20 and two steps in this sequence are shown in FIGS. 13 and 14. At about the stage shown in FIG. 13, motor 16 is actuated and remains operational until the core barrel is now in the position indicated in FIG. 15. For a fuller discussion of operations of motor 16, reference is made to said U.S. Pat. No. 4,354,558.

Figure 15:
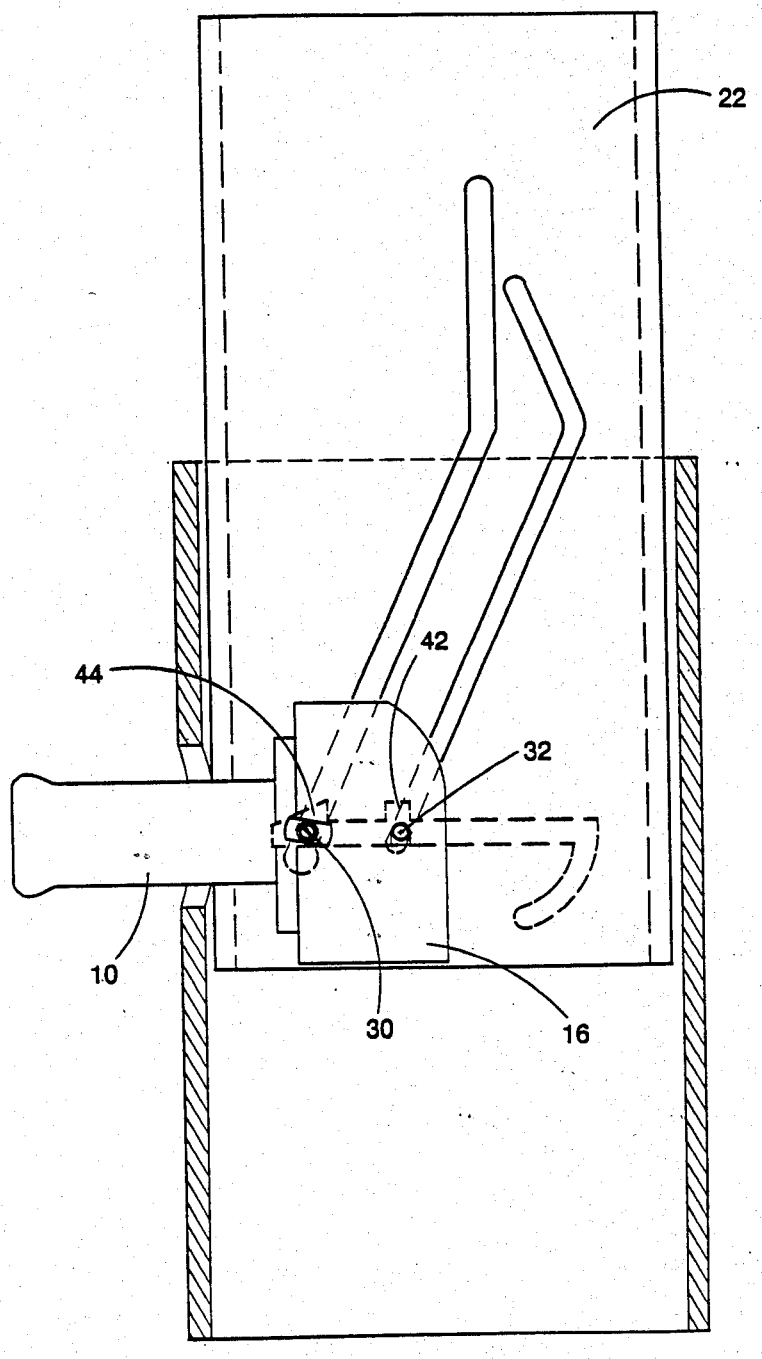
FIG. 15 is similar to FIG. 14 except the core barrel is extended to approximately the full limit.
Figure 16:
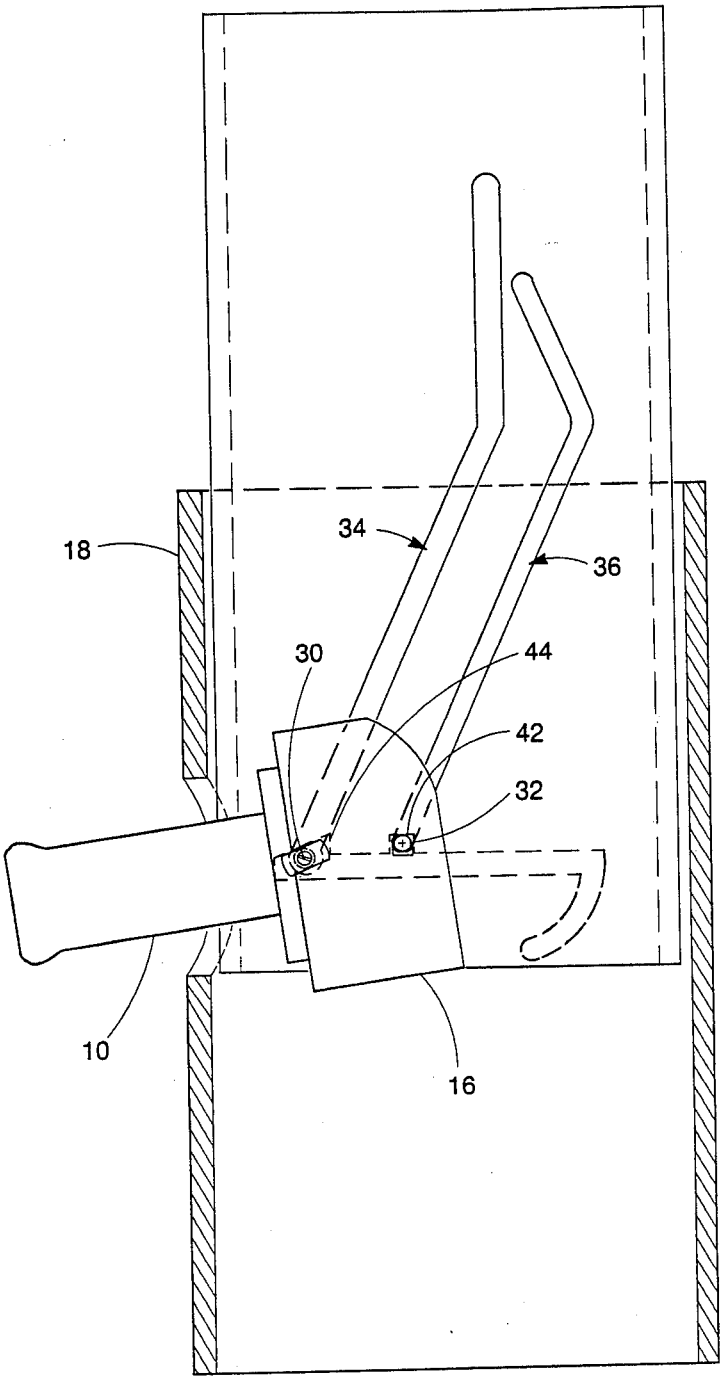
FIG. 16 is similar to FIG. 15 except that the pins of the motor have entered the break slots, and the motor assembly has rotated upwardly by pivoting around the lower lip of the core head, thus, breaking the core loose from the rock.

Additional upward movement of plate 22 as indicated by its position shown in FIG. 15 causes the core barrel 10 to extend even further out to a nearly fully-extended position. The width 30A of pinion 30 is greater than the width of break slot 42 so that only trailing pinion 32 can enter break slot 42. This permits the movement illustrated in FIGS. 14, 15 and 16. FIG. 16 shows the pinions 30 and 32 in the break slots 44 and 42, respectively, of fixed slot 38. This shows that the hydraulic motor assembly has moved upward pivoting around the outer end of the core barrel 10 causing the core to break from the sidewall rock.

After the core has been cut and broken as indicated in FIG. 16, the core barrel can be retracted and returned to the position shown in FIG. 10 by merely moving the drive plate downwardly, and the sequence will be in the reverse order and will now be in the order of FIG. 16 back through FIG. 10.

In accordance with my present invention when the tool has been reversed to the position shown in FIG. 10, sealing plug 4 is then inserted in the manner described above in regard to FIGS. 2 and 2A and 1 and 1A. The pressure coring tool can now be retrieved to the surface and the sealed pressured core barrel 10 can be removed from the motor 16 by means not specifically shown such as threads or the like and delivered to core analysis facilities. A second plug 4 can be attached to piston extension 6 and a second empty pressure core barrel can be attached to motor 16. The tool can now be lowered and a second core cut and retrieved under pressure in a manner as just described.

While the invention has been described with a certain degree of particularly, it is manifest that many changes can be made in the details of construction and the arrangements of components without departing from the spirit and scope of this disclosure. It is understood that the invention is not limited to the exemplified embodiments set forth herein but is to be limited only by the scope of the attached claim or claims including the full range of equivalency to which each element thereof is entitled.

What I claim is:

1. A method of cutting a core from a sidewall of a borehole and retaining it in a pressured condition comprising:
   - cutting a core from said sidewall by extending and rotating a core barrel having a core cutting head;
   - retracting said core barrel from the sidewall;
   - rotating said retracted core containing core barrel to a tilted position, and
   - sealing said retracted tilted core barrel with said cut core therein.

2. A method as defined in claim 1 in which said core barrel is tilted such that the bit end of said barrel is higher than the core cutting head end, then forcing a sealing plug into said pressure core barrel through said core cutting head, retaining said plug in said pressure core barrel, and removing the sealed pressure core barrel to the surface.

3. A method of cutting a core from the sidewall of a borehole using a sidewall coring tool having an opening in the wall thereof comprising:
   - extending a core barrel having a cutting head along a guide path through said opening until said head contacts said sidewall;
   - cutting a core with said head until said barrel contains a core;
   - retracting said core containing core barrel along said path;
   - sealing said core when said core barrel reaches a selected position on said path.

4. An apparatus for pressure sealing a core cut from the sidewall of a borehole comprising;
   - a housing;
   - a core barrel having a cutting head at one end;
   - means supported by said housing to extend and retract said barrel between the interior of said housing and said sidewall including means to tilt said core barrel about its longitudinal axis within said housing;
   - sealing means supported by said housing to sealingly close said core barrel after said core barrel has been tilted.

5. An apparatus as defined in claim 4 in which said sealing means include a first plug sealingly insertable in said barrel, a second plug of a size to sealingly fit into said barrel through said cutting head, and drive means supported within said housing for inserting said second plug into said barrel, and retaining means to retain said second plug therein once inserted.

6. An apparatus as defined in claim 5 including a drive plate within said housing whose movement extends and retracts said core barrel; and in which said drive means is supported by said drive plate.

7. An apparatus as defined in claim 5 in which said retaining means includes an internal latching groove in said core barrel near said cutting head and latching fingers on said second plug insertable in said latching groove.

8. An apparatus as defined in claim 7 including a retaining ring within said core barrel near the end opposite said cutting head to stop movement of said first plug.

9. An apparatus for drilling and recovering a sidewall core from a borehole under ambient pressure comprising:

an elongated housing having an opening in the wall thereof;

a fixed plate means secured to said housing and having a guide slot substantially perpendicular to the longitudinal axis of the housing and an arcuate section at one end thereof;

a drive plate means adjacent to said fixed plate means and movable with respect to said housing and having a first and second slot, said first slot having a first section parallel to said axis and a second slot forming a selected angle with said first section;

said second slot having a lower section parallel to said second section and an upper section making a second selected angle with said lower section;

drive means to move said drive plate means;

a bit assembly mounted to said housing and having guide means engaging in said guide slot means and said first and second slot to extend and retract said assembly through said opening of said housing in response to the movement of said drive plate means;

said bit assembly including a pressure core barrel having a first sealing plug slidably mounted within said barrel;

a cylinder and piston assembly supported by said drive plate means with the longitudinal axis of said piston being aligned with the longitudinal axis of said pressure core barrel when said pressure core barrel and said bit assembly is in its most retracted position;

a second sealing plug carried by said piston and insertable into said barrel in a sealing position, and means to retain said second plug in said barrel once inserted.

10. An apparatus as defined in claim 9 including drive means carried by said drive plate means for inserting said second plug into said barrel.

* * * * *